US009774140B2

(12) United States Patent
Cheng et al.

(10) Patent No.: US 9,774,140 B2
(45) Date of Patent: Sep. 26, 2017

(54) POWER RECEPTACLE HAVING SEPARABLE PLUG RETAINING FRAME

(71) Applicant: CYBER POWER SYSTEMS, INC., Taipei (TW)

(72) Inventors: Hsiung-Kuei Cheng, Taipei (TW); Huang-Chih Chen, Taipei (TW)

(73) Assignee: CYBER POWER SYSTEMS, INC., Taipei (TW)

( * ) Notice: Subject to any disclaimer, the term of this patent is extended or adjusted under 35 U.S.C. 154(b) by 0 days.

(21) Appl. No.: 15/346,396

(22) Filed: Nov. 8, 2016

(65) Prior Publication Data

US 2017/0141515 A1 May 18, 2017

(30) Foreign Application Priority Data

Nov. 13, 2015 (TW) ..... 104137488 A

(51) Int. Cl.

| | |
|---|---|
| ***H01R 13/639*** | (2006.01) |
| ***H01R 13/506*** | (2006.01) |
| *H01R 25/00* | (2006.01) |
| *H01R 103/00* | (2006.01) |
| *H01R 13/74* | (2006.01) |

(52) U.S. Cl.

CPC ..... *H01R 13/6395* (2013.01); *H01R 13/506* (2013.01); *H01R 13/741* (2013.01); *H01R 25/006* (2013.01); *H01R 2103/00* (2013.01)

(58) Field of Classification Search

CPC ..... H01R 13/6395; H01R 13/506; H01R 25/006; H01R 13/741; H01R 2103/00

USPC ..... 439/366–373, 488

See application file for complete search history.

(56) References Cited

U.S. PATENT DOCUMENTS

| | | | | |
|---|---|---|---|---|
| 7,014,493 | B1 * | 3/2006 | Battard | H01R 13/6395 439/371 |
| 7,101,215 | B2 * | 9/2006 | Woellner | H01R 13/639 439/371 |
| 7,455,546 | B1 | 11/2008 | Yoon et al. | |
| 7,722,380 | B1 * | 5/2010 | West | H01R 13/6395 439/373 |
| 8,920,191 | B2 * | 12/2014 | Carpanzano | H01R 13/74 439/491 |

FOREIGN PATENT DOCUMENTS

WO WO 2014146735 A1 9/2014

* cited by examiner

*Primary Examiner* — Edwin A. Leon
(74) *Attorney, Agent, or Firm* — Bacon & Thomas, PLLC

(57) ABSTRACT

A power receptacle having at least one separable plug retaining frame includes a shell body, at least one outlet element and at least one plug retaining frame. The shell body as at least one first through hole, the outlet element is fixed on the shell body and has at least one outlet, and the plug retaining frame has at least one first bending portion, at least one second bending portion and at least one first retaining slot outlet element such that at least one outlet of the outlet element is exposed to the first through hole, and the first and second bending portions are held together by the outlet element and the shell body. As a result, a plug strap can be inserted into the first retaining slot, and the color of the plug retaining frame will indicate the function or the group of the outlet element.

17 Claims, 17 Drawing Sheets

POWER RECEPTACLE HAVING SEPARABLE PLUG RETAINING FRAME

BACKGROUND OF THE INVENTION

1. Field of the Invention

The invention relates to a power receptacle, and more particularly to a power receptacle having separable plug retaining frame, the power receptacle has at least one outlet, a plug can be plugged into the outlet, a plug retaining strap can be used to fix the plug on the plug retaining frame.

2. Description of Related Art

A first prior-art is disclosed in U.S. Pat. No. 7,455,546, the first prior-art disclosed a power strip has a flange, the flange has a plurality of rectangular slots, each of the rectangular slots can be inserted a strap to fix a power cord plug. The flange belongs to shell structure of the power strip, it is difficult to replace the flange. Moreover, the flange is not used to indicate the function of the electrical outlets or the group of the electrical outlets. Thus, there is a requirement of improvement for the first prior-art.

A second prior-art is disclosed in PCT Patent No. WO2014146735, the second prior-art disclosed an electrical outlet apparatus having a flange, the flange is adjacent to a wall, a link receptacle protrudes from the flange, the link receptacle can be inserted a link member. The material of the flange is same to the material of the link receptacle and the material of the wall, therefore the color of the flange is same to the color of the link receptacle and the color of the wall. A plurality of the link receptacles are not used to indicate the function of the electrical outlets or the group of the electrical outlets. Thus, there is a requirement of improvement for the second prior-art.

SUMMARY OF THE INVENTION

It is therefore a first object of the invention to provide a power receptacle having separable plug retaining frame, the power receptacle comprises a shell body, at least one outlet element and at least one plug retaining frame; wherein the outlet element and the plug retaining frame can be fixed on the shell body, at least one outlet of the outlet element can be exposed to the shell body, at least one first retaining slot of the plug retaining frame can be inserted a plug strap, the color of the plug retaining frame can be used to indicate the function of the outlet element or the group of the outlet element.

It is therefore a second object of the invention to provide a power receptacle having separable plug retaining frame, the power receptacle comprises a shell body, at least one outlet element, at least one plug retaining frame and a cover plate; wherein the outlet element and the plug retaining frame can be fixed on the shell body, at least one outlet of the outlet element can be exposed to the shell body, at least one first retaining slot of the plug retaining frame and at least one second retaining slot of the cover plate can be inserted a plug strap, the color of the cover plate can be used to indicate the function of the outlet element or the group of the outlet element.

It is therefore a third object of the invention to provide a power receptacle having separable plug retaining frame, the power receptacle comprises a shell body, at least one outlet element and at least one plug retaining frame, the plug retaining frame has a light guiding portion; wherein the outlet element and the plug retaining frame can be fixed on the shell body, at least one outlet of the outlet element can be exposed to the shell body, at least one first retaining slot of the plug retaining frame can be inserted a plug strap.

First advantages of the invention is, the power receptacle can selectively use a plug retaining frame of particular color according to the function of the outlet element or the group of the outlet element, therefore the power receptacle can be produced by a manufacturing way of BTO (Build to order). That will be provided with an advantage of customization, and that will bring down inventory. Moreover, when the first retaining slot of the plug retaining frame is broken, a repairman of manufacturer can replace the plug retaining frame to repair the power receptacle.

Second advantages of the invention is, the plug retaining frame has at least one breach, the shell body can be provided with at least one light guiding element, the top surface of light guiding element is located in the breach, therefore the top surface of the light guiding element is near to at least one outlet of the outlet element.

Third advantages of the invention is, the power receptacle can be provided with a plurality of plug retaining frames and a plurality of outlet elements; wherein the plug retaining frames have different colors each other, the outlet elements can use the plug retaining frames to indicate the different function or the different group.

Fourth advantages of the invention is, the power receptacle can selectively use a cover plate of particular color according to the function of the outlet element or the group of the outlet element, therefore the power receptacle can be produced by a manufacturing way of BTO (Build to order). That will be provided with an advantage of customization, and that will bring down inventory. Moreover, when user would like to change the function of the outlet element or the group of the outlet element, the user can replace another cover plate of different color by himself, and the user does not need to dismantle the plug retaining frame and the outlet element.

Fifth advantages of the invention is, the power receptacle can be provided with a plurality of plug retaining frames, a plurality of covers and a plurality of outlet elements, the color of each cover is different, the outlet elements can use the covers to indicate the different function or the different group.

Sixth advantages of the invention is, the plug retaining frame has at least one light guiding portion, the light guiding portion is near to at least one outlet of the outlet element.

The above and other objects, features and advantages of the invention will become apparent from the following detailed description taken with the accompanying drawings.

DETAILED DESCRIPTION OF THE INVENTION

Figure 1:
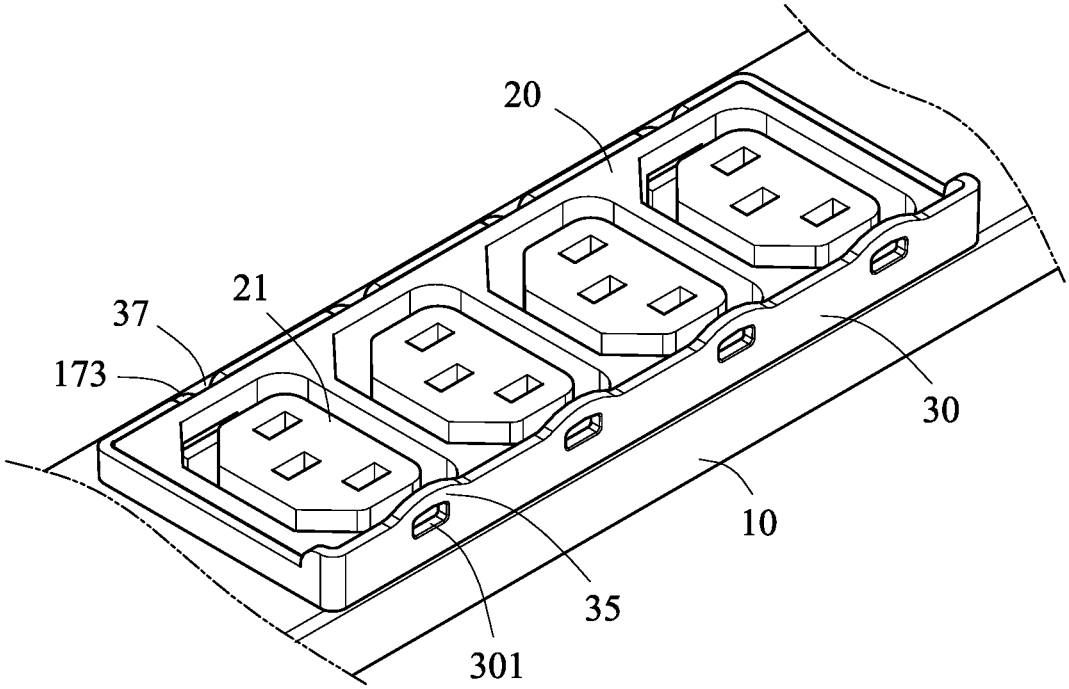
FIG. 1 is a perspective view showing a first preferred embodiment of the invention.
Figure 2:
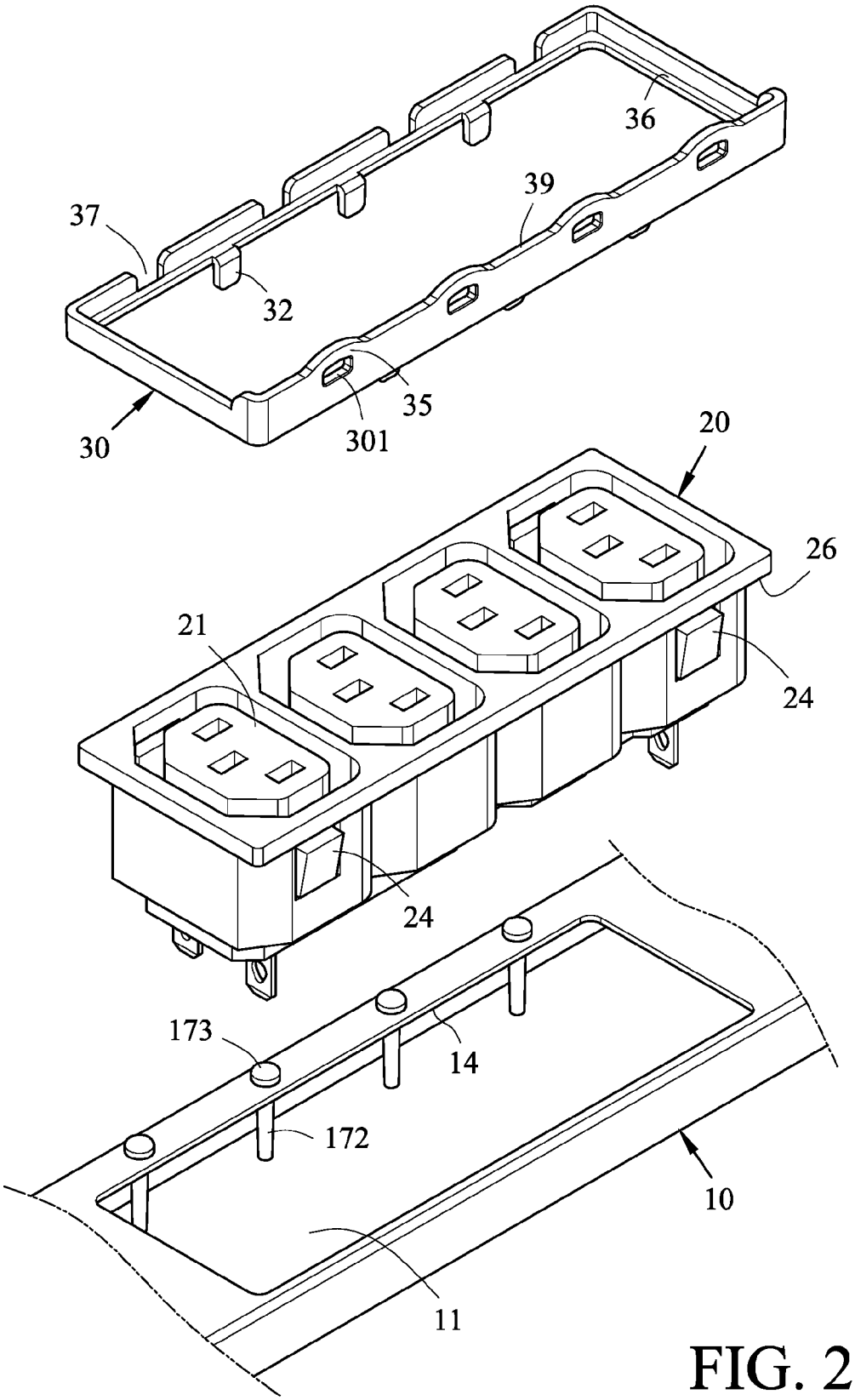
FIG. 2 is an exploded view showing the first preferred embodiment of the invention.
Figure 3:
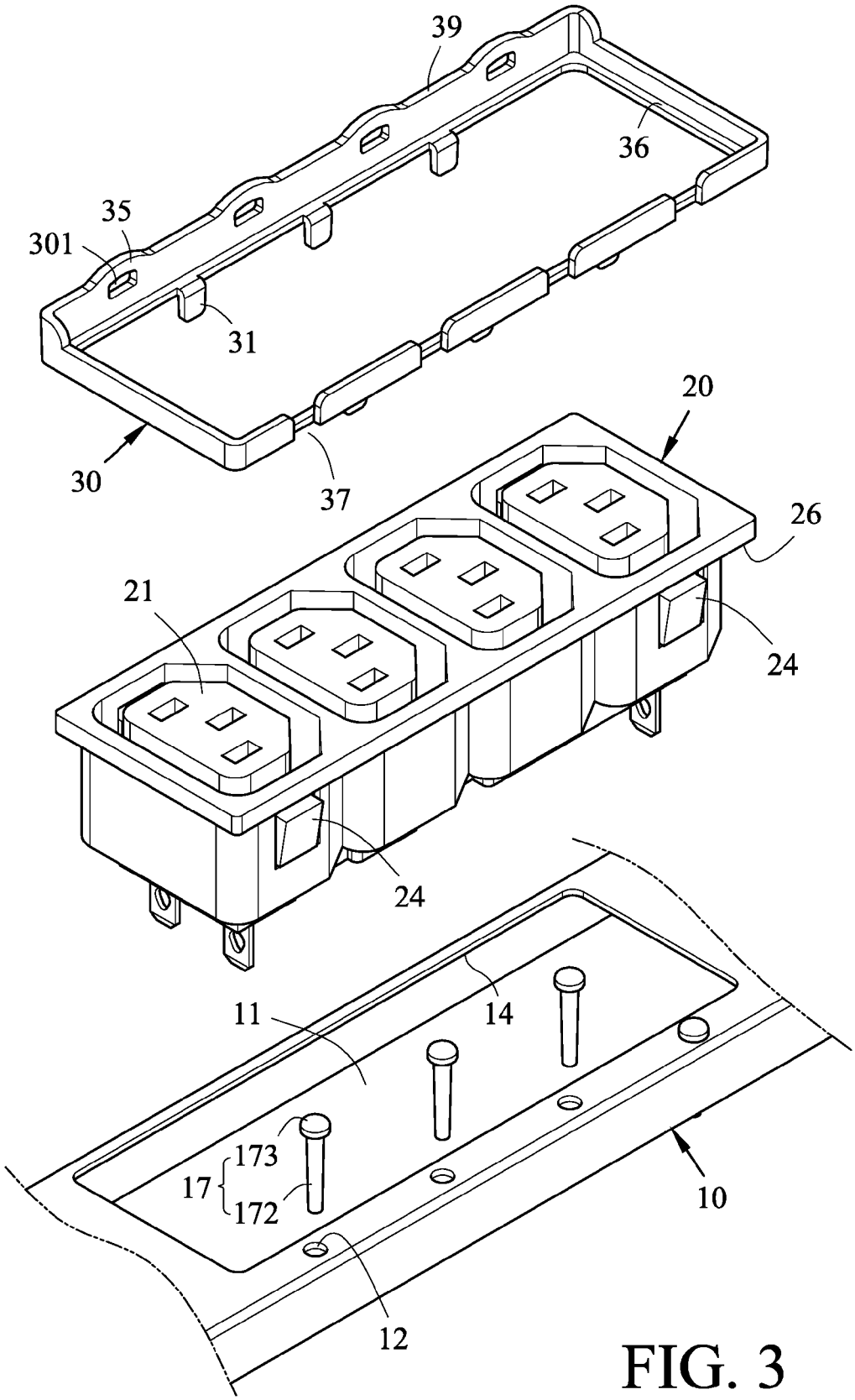
FIG. 3 is another exploded view showing the first preferred embodiment of the invention.
Figure 4:
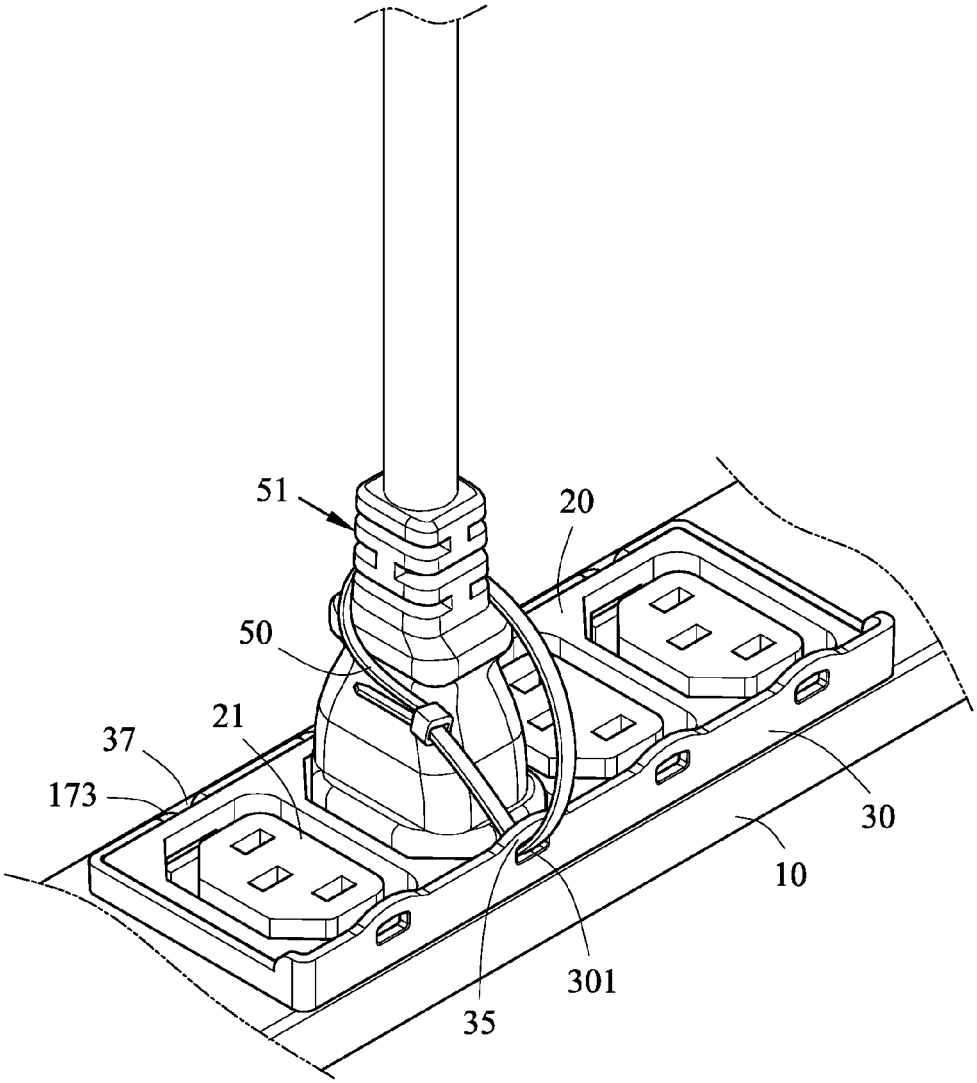
FIG. 4 is the first preferred embodiment diagram of the invention illustrating a plug be fixed by a plug retaining strap.
Figure 5:
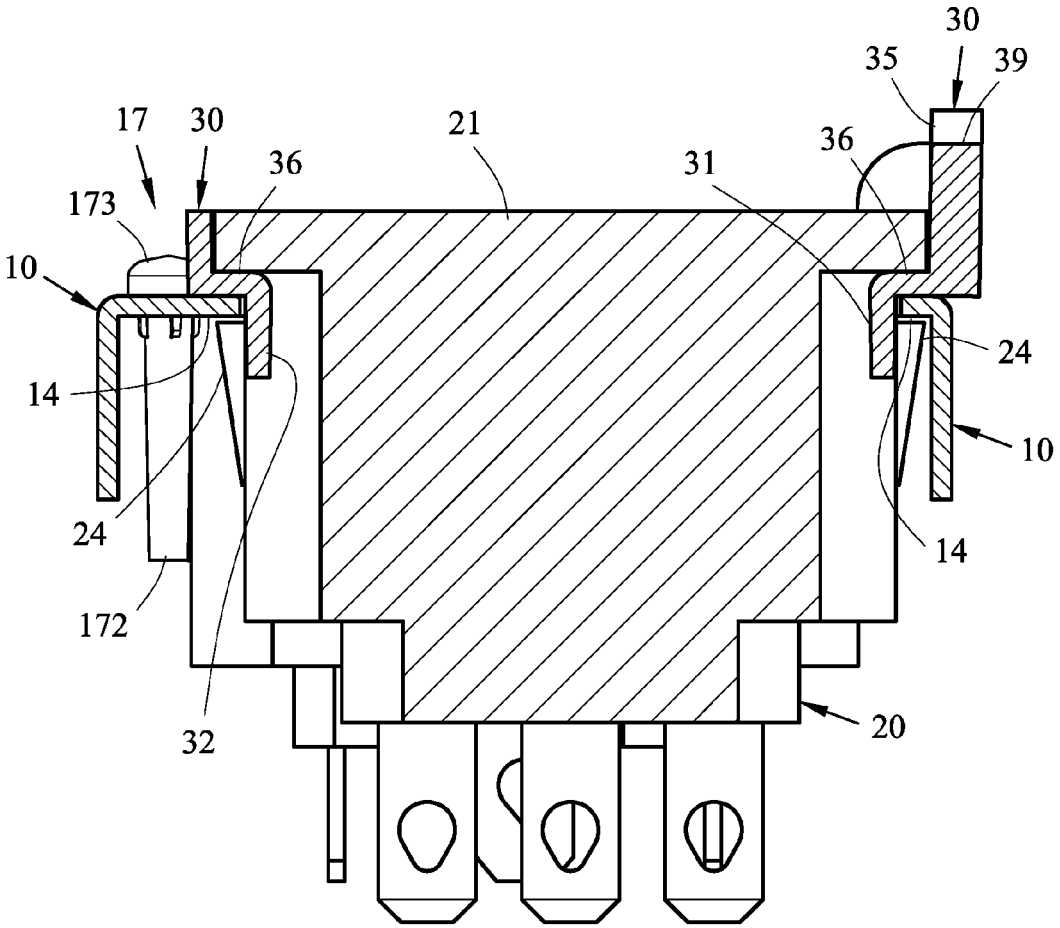
FIG. 5 is a partly cross-sectional view showing the first preferred embodiment state of the invention.

Referring to FIGS. 1 to 5, a power receptacle in accordance with a first embodiment of the invention comprises a shell body 10, at least one outlet element 20 and at least one plug retaining frame 30; the shell body 10 has at least one first through hole 11, the outlet element 20 has at least one outlet 21; the plug retaining frame 30 has at least one first bending portion 31, at least one second bending portion 32 and at least one first retaining slot 301; wherein the outlet element 20 can be fixed on the shell body 10, the outlet 21 can be exposed to the first through hole 11, the first bending portion 31 and the second bending portion 32 can be held together by the outlet element 20 and the shell body 10, therefore the first retaining slot 301 can be inserted a plug strap 50, and the color of the plug retaining frame 30 can indicate the outlet element 20. When a plug 51 is plugged into the outlet 21, the plug retaining strap 50 can be used to fix the plug 51 on the plug retaining frame 30, that will prevent the plug 51 is loosed. As a result of the plug retaining frame 30 is a design of separable structure, the power receptacle of the invention can selectively use the plug retaining frame 30 of particular color according to the function of the outlet element 20 or the group of the outlet element 20, therefore the power receptacle can be produced by a manufacturing way of BTO (Build to order). That will be provided with an advantage of customization, and that will bring down inventory. Moreover, when the first retaining slot 301 is broken, a repairman of manufacturer can replace the plug retaining frame 30 to repair the power receptacle.

Examples of a fixing manner of the plug retaining frame 30, the outlet element 20 has a plurality of conical blocks 24. When the outlet element 20 is fixed on the shell body 10, the conical blocks 24 can block an inner face 14 of the shell body 10, therefore the first bending portion 31 and the second bending portion 32 can be held together by the outlet element 20 and the shell body 10. Moreover, the outlet element 20 has an outside rim 26, the plug retaining frame 30 has an inside rim 36. When the outlet element 20 is fixed on the shell body 10, the outside rim 26 and the shell body 10 can together clamp the inside rim 36.

Examples of a first variation of the plug retaining frame 30, the plug retaining frame 30 has at least one breach 37, the shell body 10 can be provided with at least one light guiding element 17, the top surface 173 of light guiding element 17 is partly located in the breach 37, a pillar body 172 is embedded on at least one second through hole 12 of the shell body 10, therefore the top surface 173 of the light guiding element 17 is near to the outlet 21, the light guiding element 17 can guide a light source, for example, a LED (light emitting diode) light source (not shown).

Examples of a second variation of the plug retaining frame 30, the first retaining slot 301 has at least one first protruding portion 35, the first retaining slot 301 is biased toward the external side 39 of the plug retaining frame 30. A large distance is formed between the first retaining slot 301 and the outlet 21, therefore the first retaining slot 301 is easy to insert the plug strap 50.

Figure 6:
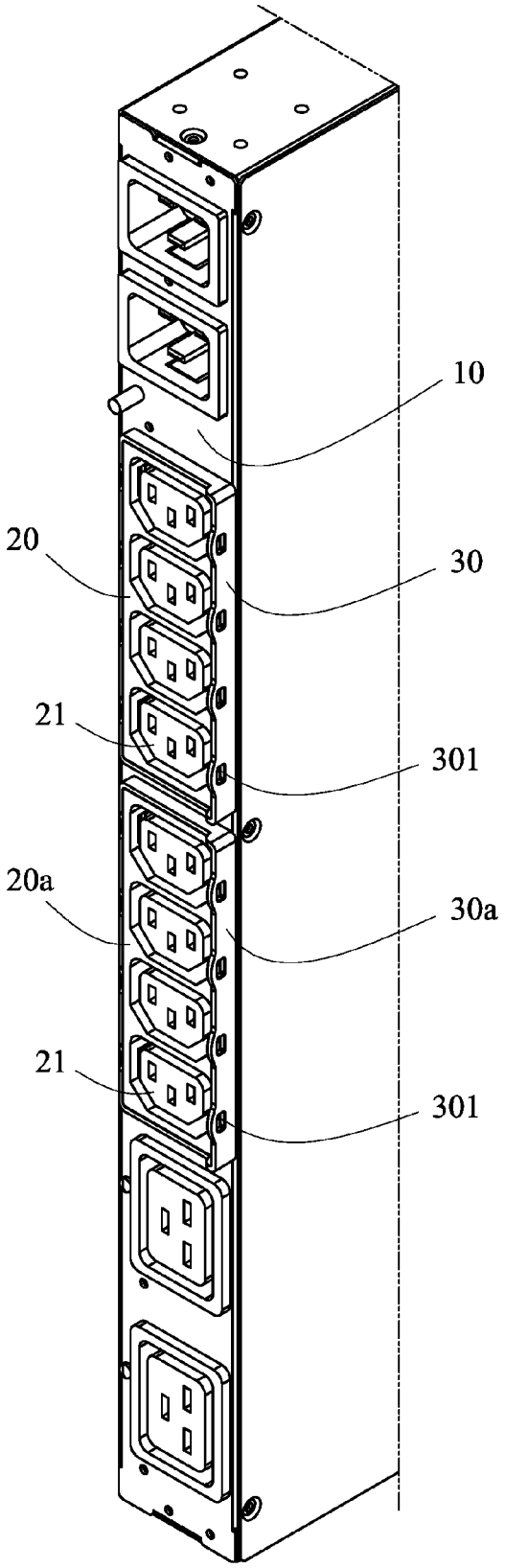
FIG. 6 is a perspective view showing the first preferred embodiment of the invention be provided with a plurality of plug retaining frames and a plurality of outlet elements.
Figure 7:
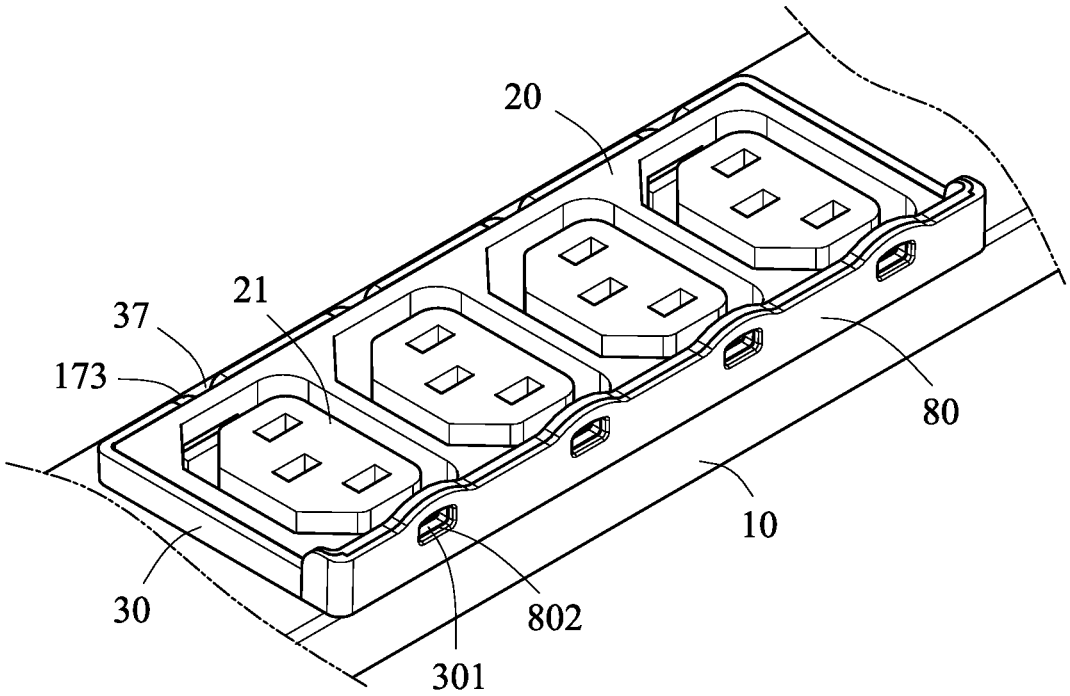
FIG. 7 is a perspective view showing a second preferred embodiment of the invention.
Figure 8:
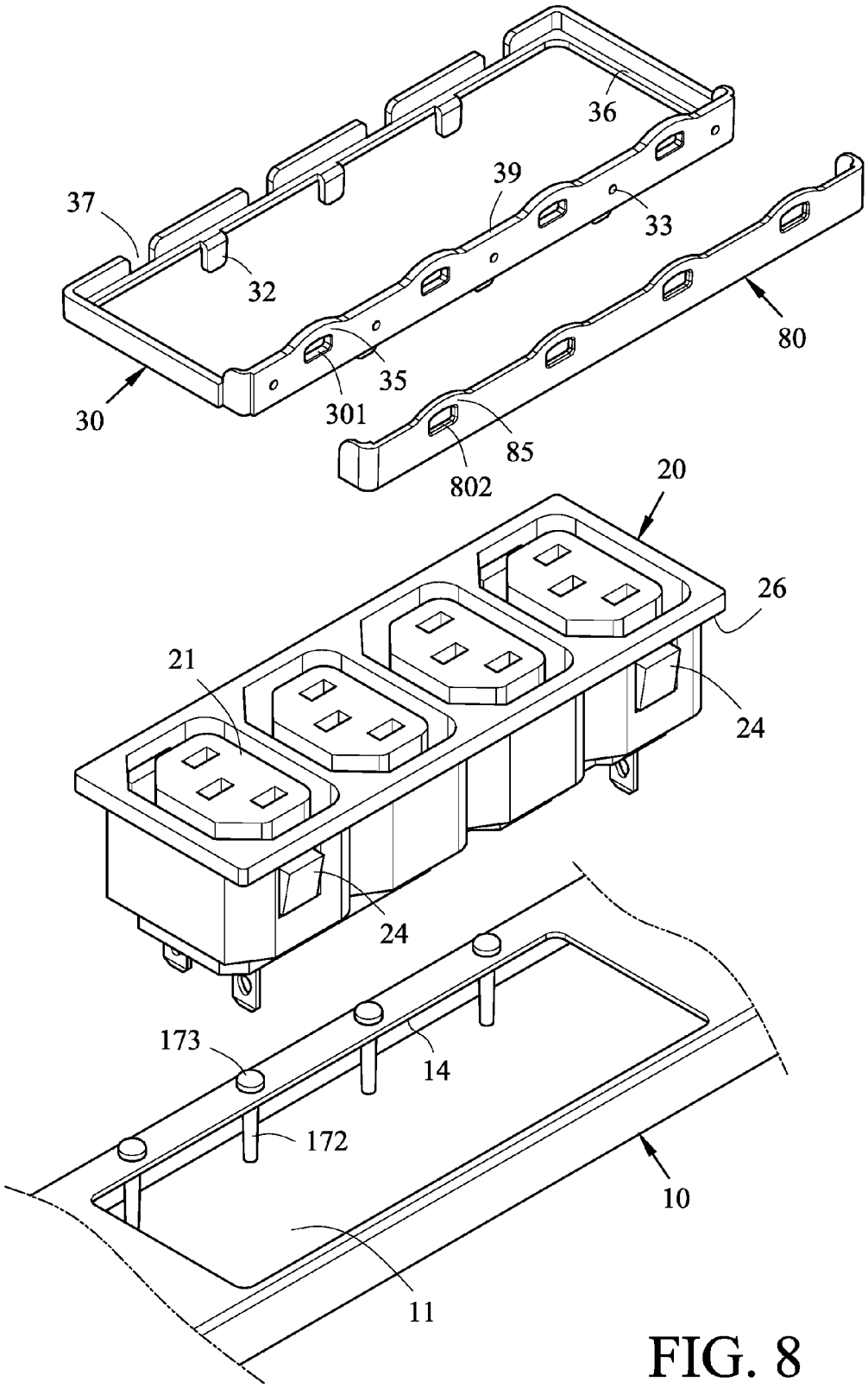
FIG. 8 is an exploded view showing the second preferred embodiment of the invention.
Figure 9:
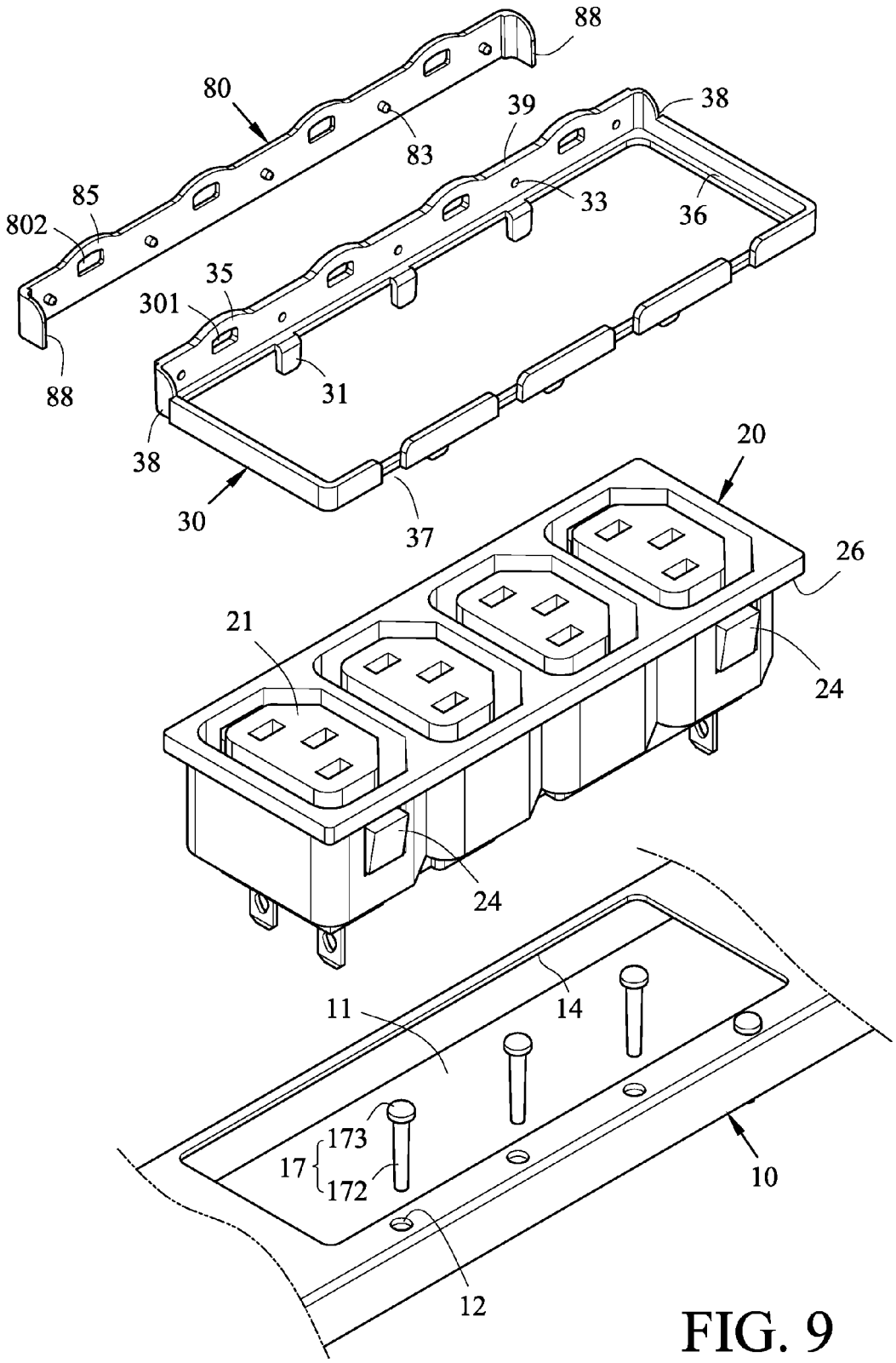
FIG. 9 is another exploded view showing the second preferred embodiment of the invention.
Figure 10:
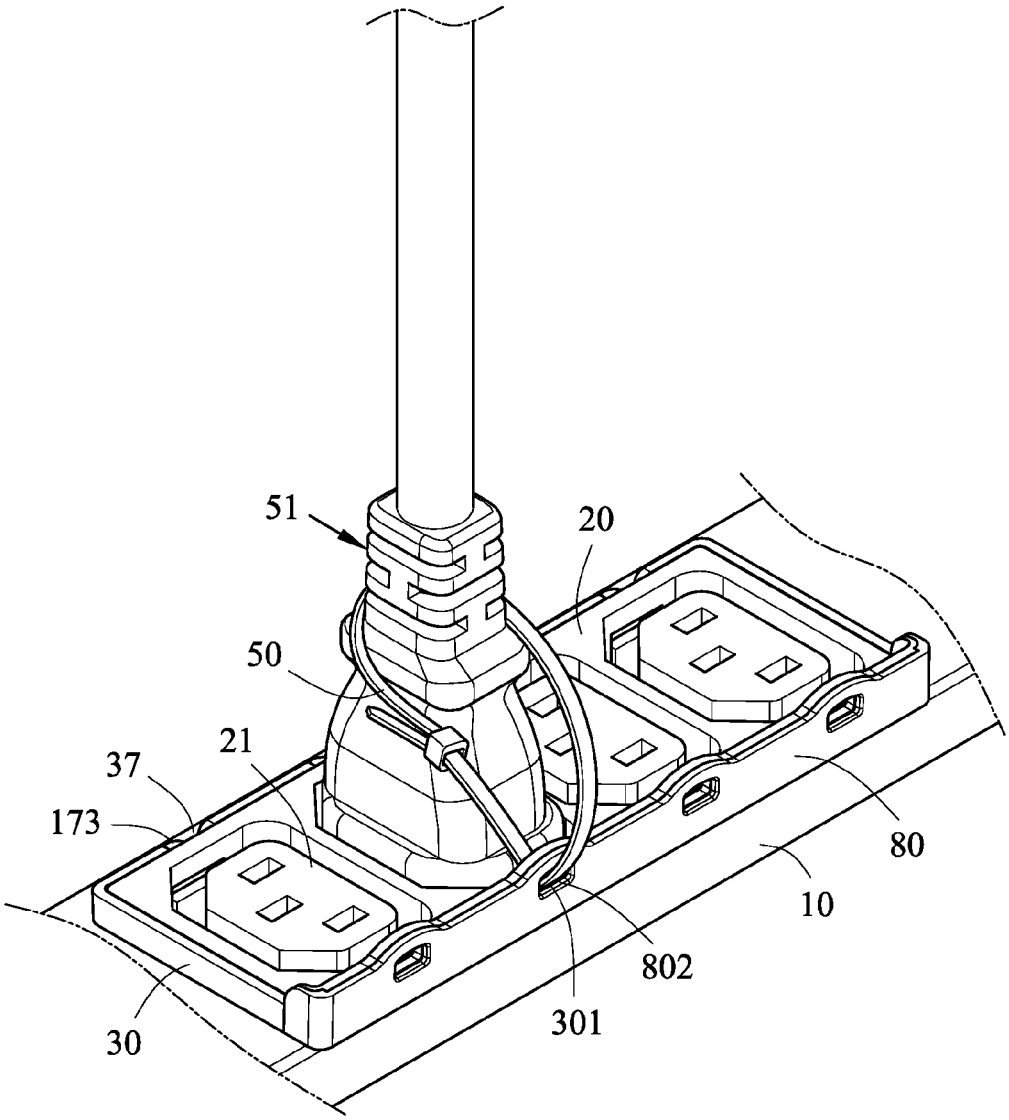
FIG. 10 is the second preferred embodiment diagram of the invention illustrating a plug be fixed by a plug retaining strap.
Figure 11:
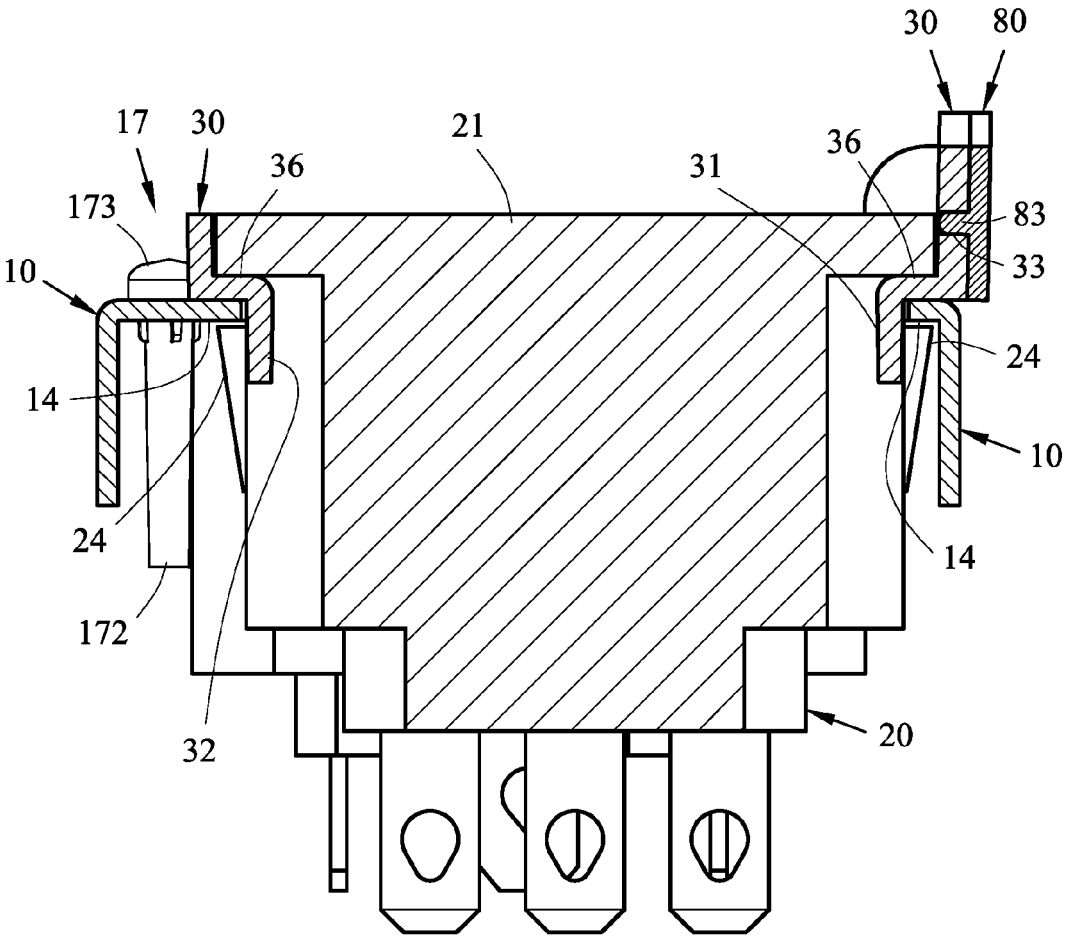
FIG. 11 is a partly cross-sectional view showing the second preferred embodiment state of the invention.

Referring to FIG. 6, in the first embodiment of the invention, the power receptacle can be provided with a plurality of the plug retaining frames 30, 30*a* and a plurality of the outlet elements 20, 20*a*. The plug retaining frames 30, 30*a* have different colors each other, the outlet elements 20, 20*a* can use the plug retaining frames 30, 30*a* to indicate the different function or the different group. For example, the plug retaining frame 30 is provided with a first color, the outlet element 20 can use the first color of the plug retaining frame 30 to indicate that the outlet element 20 is belonged to a first function or a first group; the plug retaining frame 30*a* is provided with a second color, the outlet element 20*a* can use the second color of the plug retaining frame 30*a* to indicate that the outlet element 20*a* is belonged to a second function or a second group.

Referring to FIGS. 7 to 11, a second embodiment is almost same as the first embodiment of the invention, the difference between them is, the power receptacle further comprises a cover plate 80, the cover plate 80 has at least one second retaining slot 802, the cover plate 80 can be fixed on the plug retaining frame 30, the second retaining slot 802 is overlapped to the first retaining slot 301; wherein the outlet element 20 can be fixed on the shell body 10, the outlet 21 can be exposed to the first through hole 11, the first bending portion 31 and the second bending portion 32 can be held together by the outlet element 20 and the shell body 10, therefore the first retaining slot 301 and the second retaining slot 802 can be inserted a plug strap 50, and the color of the cover plate 80 can indicate the outlet element 20. As a result of the cover plate 80 is a design of separable structure, the power receptacle of the invention can selectively use the cover plate 80 of particular color according to the function of the outlet element 20 or the group of the outlet element 20, therefore the power receptacle can be produced by a manufacturing way of BTO. That will be provided with an advantage of customization, and that will bring down inventory. Moreover, when user would like to change the function of the outlet element 20 or the group of the outlet element 20, the user can replace another cover plate 80 of different color by himself, and the user does not need to dismantle the plug retaining frame 30 and the outlet element 20, therefore the power receptacle of the invention has more practicality.

Examples of a fixing manner of the cover plate 80, the cover plate 80 has a plurality of fixing pillars 83, the plug retaining frame 30 has a plurality of fixing holes 33, each of the fixing pillars 83 can be fixed on each of the fixing holes 33, a pair of extending portions 88 of the cover plate 80 can press close to a pair of concavo portions 38 of the plug retaining frame 30, the extending portions 88 are located at two sides of the cover plate 80, and the concavo portions 38 are located at two sides of the plug retaining frame 30.

Examples of a variation of the plug retaining frame 30 and the cover plate 80, the first retaining slot 301 has at least one first protruding portion 35, the second retaining slot 802 has at least one second protruding portion 85, the first retaining slot 301 and the second retaining slot 802 are biased toward the external side 39 of the plug retaining frame 30. A large distance is formed between the first retaining slot 301 and the outlet 21, a large distance is formed between the second retaining slot 802 and the outlet 21, therefore the first retaining slot 301 and the second retaining slot 802 are easy to insert the plug strap 50.

Figure 12:
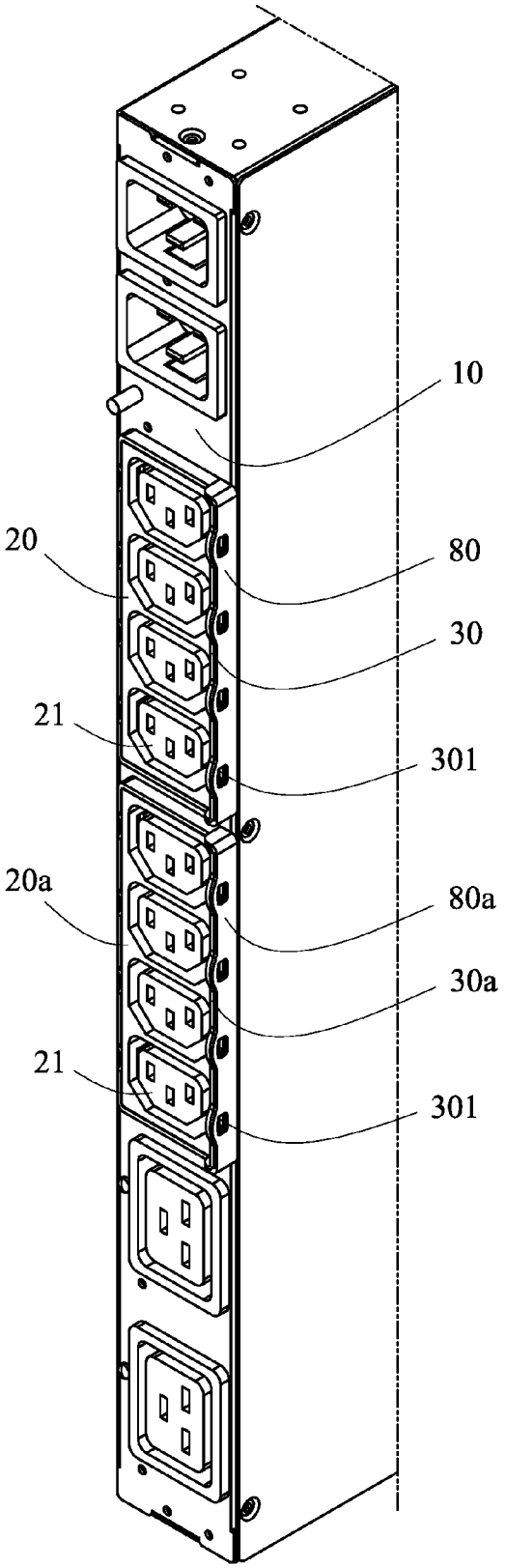
FIG. 12 is a perspective view showing the second preferred embodiment of the invention be provided with a plurality of plug retaining frames and a plurality of outlet elements.
Figure 13:
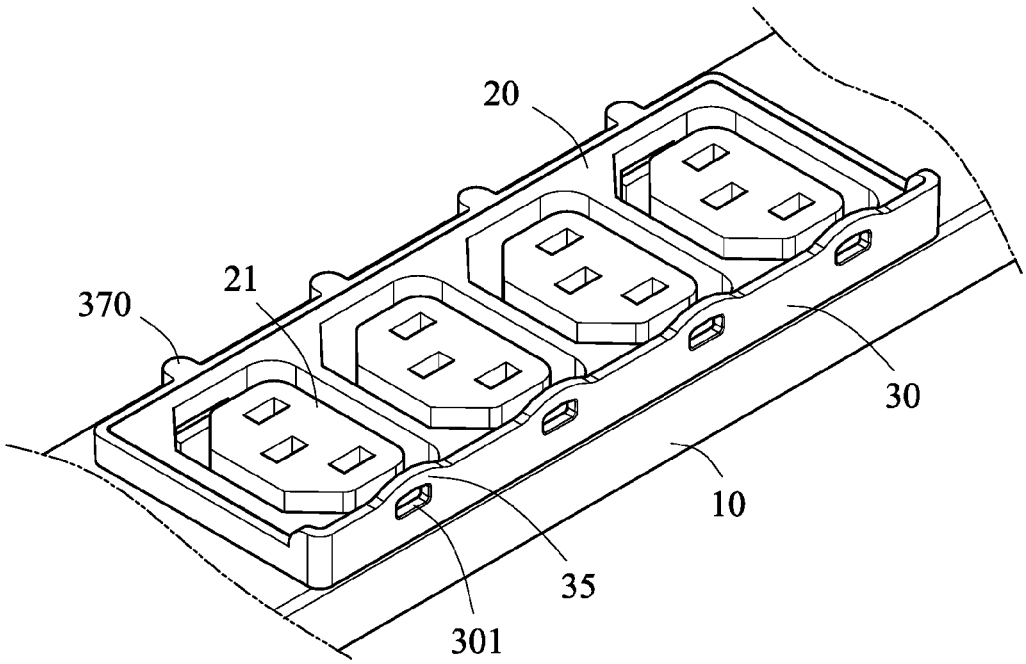
FIG. 13 is a perspective view showing a third preferred embodiment of the invention.
Figure 14:
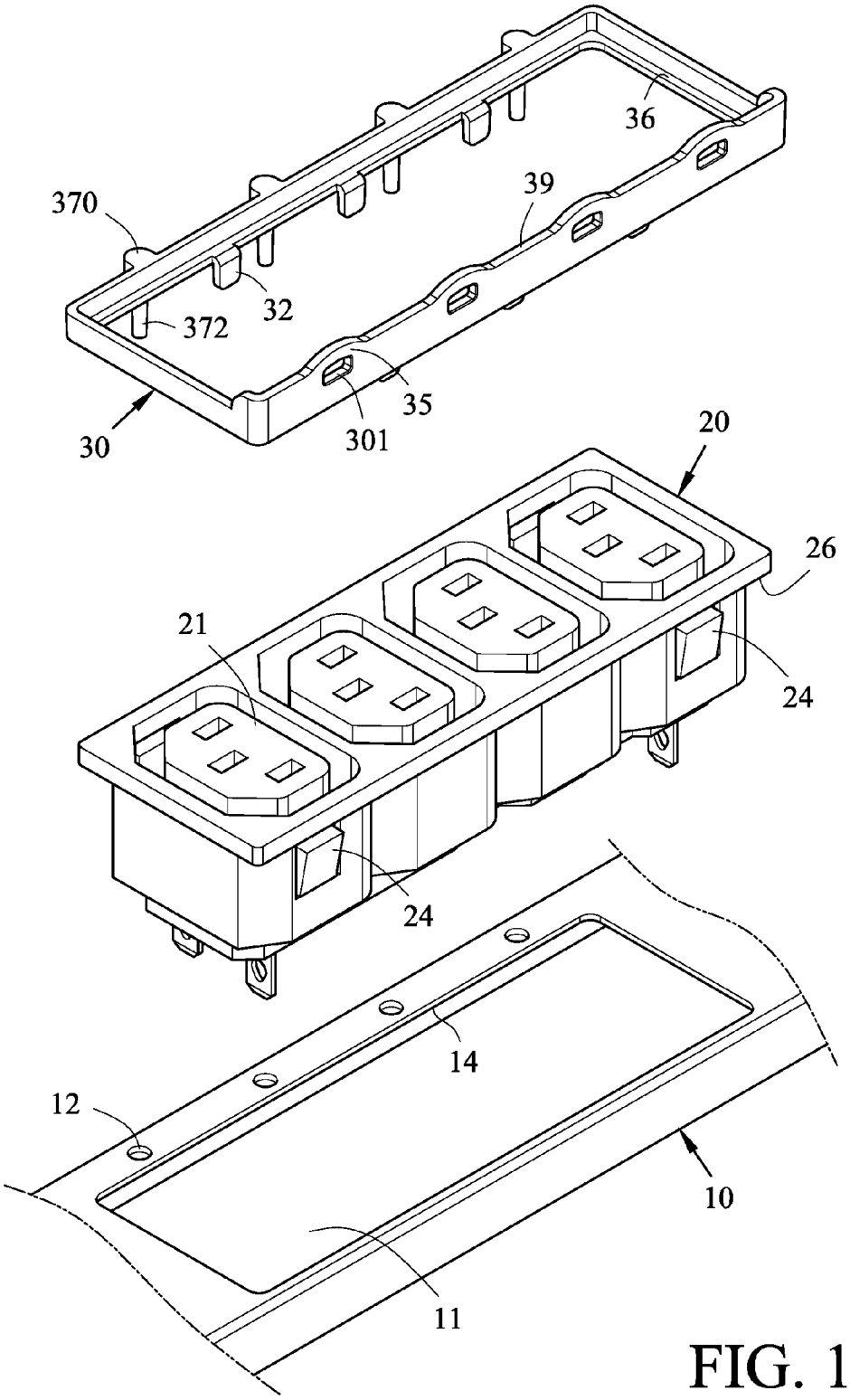
FIG. 14 is an exploded view showing the third preferred embodiment of the invention.
Figure 15:
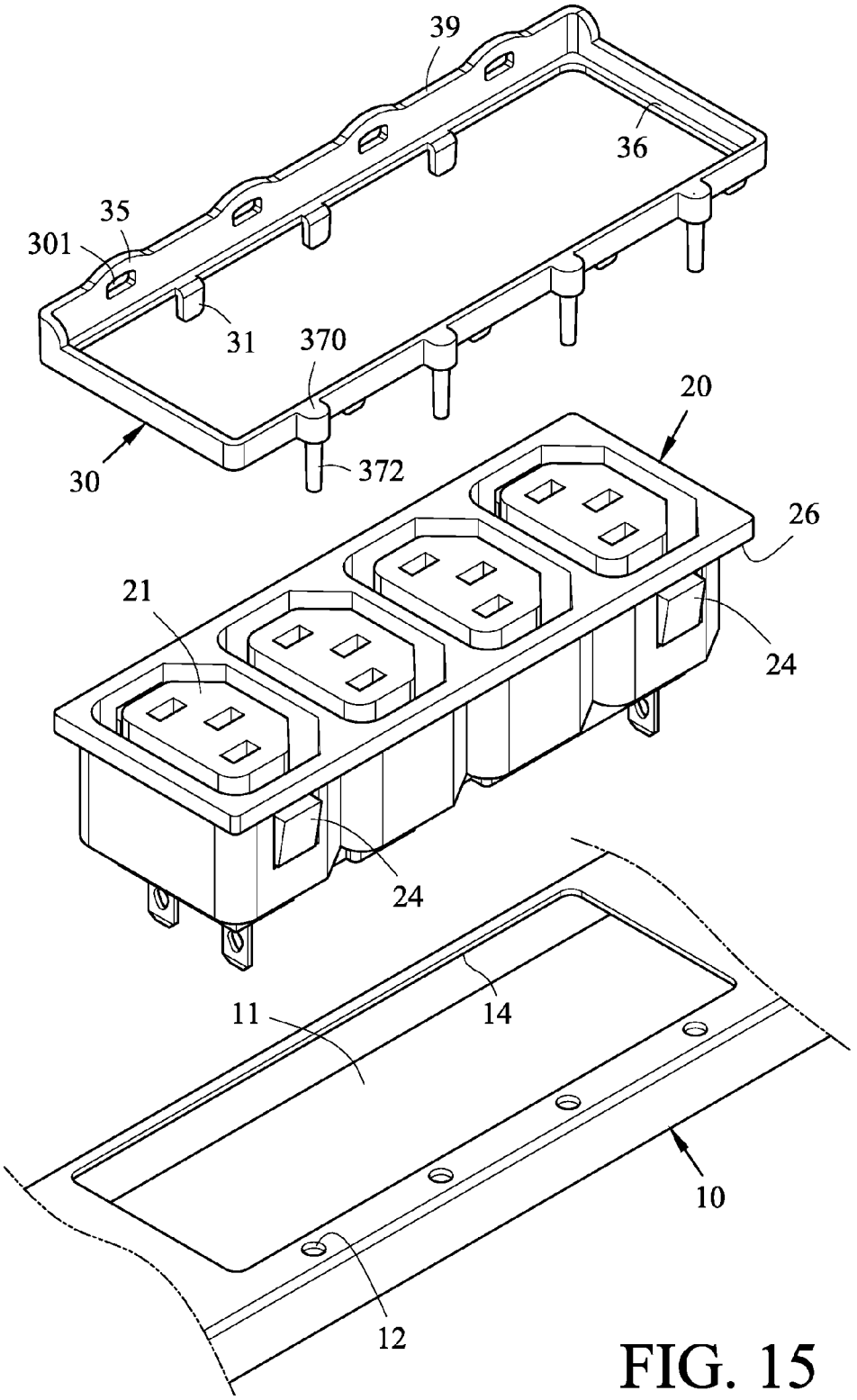
FIG. 15 is another exploded view showing the third preferred embodiment of the invention.
Figure 16:
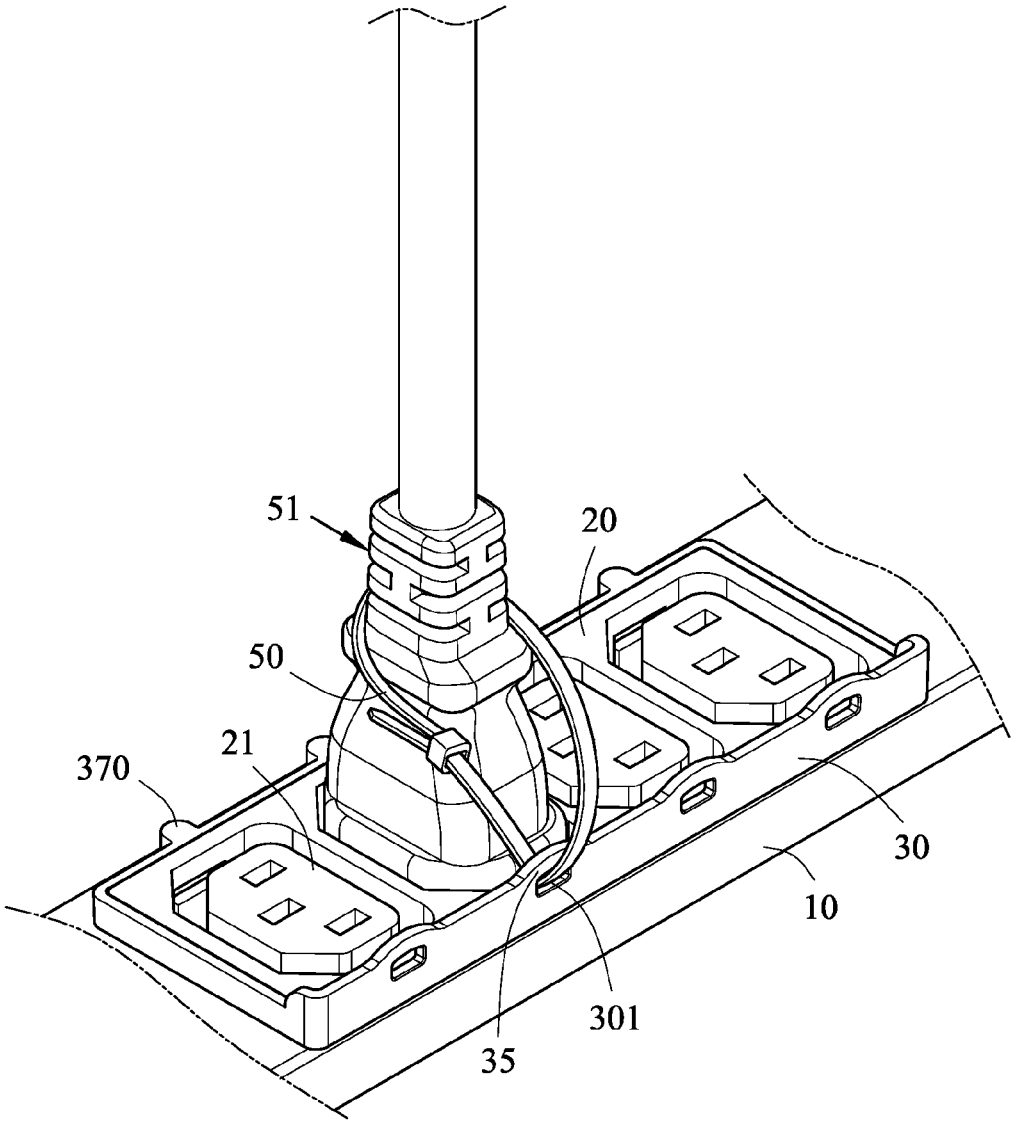
FIG. 16 is the third preferred embodiment diagram of the invention illustrating a plug be fixed by a plug retaining strap.
Figure 17:
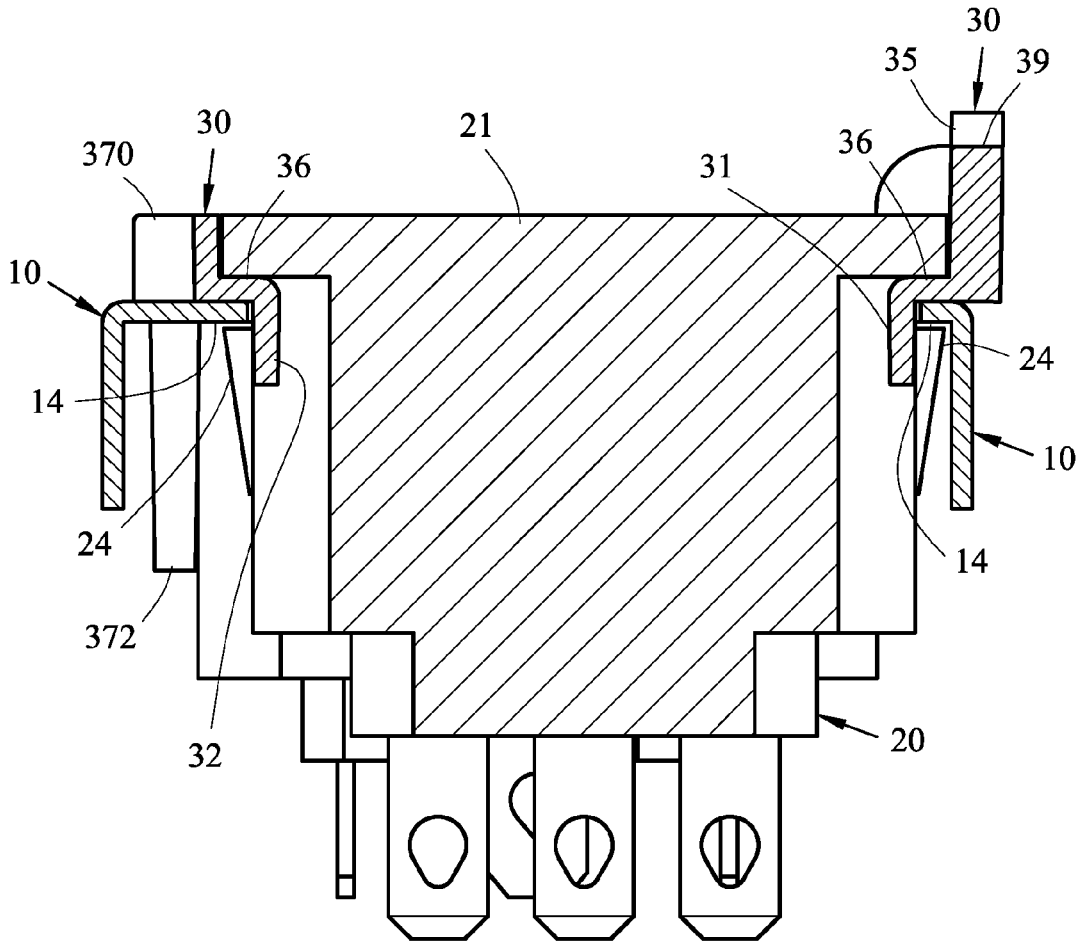
FIG. 17 is a partly cross-sectional view showing the third preferred embodiment state of the invention.

Referring to FIG. 12, in the second embodiment of the invention, the power receptacle can be provided with a plurality of the plug retaining frames 30, 30*a*, a plurality of the cover plates 80, 80*a* and a plurality of the outlet elements 20, 20*a*. The cover plates 80, 80*a* have different colors each other, the outlet elements 20, 20*a* can use the cover plates 80, 80*a* to indicate the different function or the different group. For example, the cover plate 80 is provided with a first color, the outlet element 20 can use the first color of the cover plate 80 to indicate that the outlet element 20 is belonged to a first function or a first group; the cover plate 80*a* is provided with a second color, the outlet element 20*a* can use the second color of the cover plate 80*a* to indicate that the outlet element 20*a* is belonged to a second function or a second group. Moreover, when user would like to change the functions of the outlet elements 20, 20*a* or the groups of the outlet elements 20, 20*a*, the user can replace another cover plates 80, 80*a* of different color by himself, and the user does not need to dismantle the plug retaining frames 30, 30*a* and the outlet elements 20, 20*a*, therefore the power receptacle of the invention has more practicality.

Referring to FIGS. 13 to 17, a third embodiment is almost same as the first embodiment of the invention, the difference between them is, the plug retaining frame 30 has at least one light guiding portion 370; wherein the outlet element 20 can be fixed on the shell body 10, the outlet 21 can be exposed to the first through hole 11, a pillar body 372 of the light guiding portion 370 can insert into a second through hole 12 of the shell body 10, the first bending portion 31 and the second bending portion 32 can be held together by the outlet element 20 and the shell body 10, therefore the first retaining slot 301 can be inserted a plug strap 50, the light guiding portion 370 is near to the outlet 21, the light guiding portion 370 can guide a light source, for example, a LED light source (not shown).

What is claimed is:

1. A power receptacle having at least one separable plug retaining frame, the power receptacle comprising:

a shell body (10) having at least one first through hole (11);

at least one outlet element (20), the outlet element (20) has at least one outlet (21);

at least one plug retaining frame (30), the plug retaining frame (30) has at least one first bending portion (31), at least one second bending portion (32) and at least one first retaining slot (301);

wherein the outlet element (20) is fixed on the shell body (10), the outlet (21) is exposed to the first through hole (11), the first bending portion (31) and the second bending portion (32) are held together by the outlet element (20) and the shell body (10), and a plug strap (50) is arranged to be inserted into the first retaining slot (301), and wherein a color of the plug retaining frame (30) indicates a function or a group of the outlet element (20).

2. The power receptacle of claim 1, wherein the outlet element (20) has a plurality of conical blocks (24), the conical blocks (24) block an inner face (14) of the shell body (10) when the outlet element (20) is fixed on the shell body (10), so that the first bending portion (31) and the second bending portion (32) are held together by the outlet element (20) and the shell body (10).

3. The power receptacle of claim 1, wherein the outlet element (20) has an outside rim (26), the plug retaining frame (30) has an inside rim (36), and the outside rim (26) and the shell body (10) together clamp the inside rim (36) when the outlet element (20) is fixed on the shell body (10).

4. The power receptacle of claim 1, wherein the plug retaining frame (30) has at least one breach (37), the shell body (10) is provided with at least one light guiding element (17), the top surface (173) of light guiding element (17) is partly located in the breach (37), a pillar body (172) is embedded on at least one second through hole (12) of the shell body (10), so that the top surface (173) of the light guiding element (17) is near to the outlet (21) and the light guiding element (17) guides a light source.

5. The power receptacle of claim 1, wherein the first retaining slot (301) has at least one first protruding portion (35) and the first retaining slot (301) is biased toward the external side (39) of the plug retaining frame (30) to facilitate insertion of plug strap (50) into the first retaining slot (301).

6. The power receptacle having of claim 1, wherein the power receptacle is provided with a plurality of the plug retaining frames (30, 30*a*) and a plurality of the outlet elements (20, 20*a*); the plug retaining frames (30, 30*a*) have different colors, and therefore each of the plug retaining frames (30, 30*a*) provides an indication of the respective functions of each of the outlet elements (20, 20*a*) or the respective group of each of the outlet elements (20, 20*a*).

7. A power receptacle having at least one separable plug retaining frame, the power receptacle comprising:

a shell body (10) having at least one first through hole (11);

at least one outlet element (20), the outlet element (20) has at least one outlet (21);

at least one plug retaining frame (30), the plug retaining frame (30) has at least one first bending portion (31), at least one second bending portion (32) and at least one first retaining slot (301);

at least one cover plate (80), the cover plate (80) has at least one second retaining slot (802), the cover plate (80) is fixed on the plug retaining frame (30), the second retaining slot (802) is overlapped to the first retaining slot (301);

wherein the outlet element (20) is fixed on the shell body (10), the outlet (21) is exposed to the first through hole (11), the first bending portion (31) and the second bending portion (32) are held together by the outlet element (20) and the shell body (10), and a plug strap (50) is arranged to be inserted into the first retaining slot (301) and the second retaining slot (802), and wherein a color of the cover plate (80) indicates a function or a group of the outlet element (20).

8. The power receptacle of claim 7, wherein the cover plate (80) has a plurality of fixing pillars (83), the plug retaining frame (30) has a plurality of fixing holes (33), the fixing pillars (83) are fixed on the fixing holes (33), and a pair of extending portions (88) of the cover plate (80) are pressed close to a pair of recessed portions (38) of the plug retaining frame (30).

9. The power receptacle of claim 7, wherein the outlet element (20) has a plurality of conical blocks (24), the conical blocks (24) block an inner face (14) of the shell body (10) when the outlet element (20) is fixed on the shell body (10), so that the first bending portion (31) and the second bending portion (32) are held together by the outlet element (20) and the shell body (10).

10. The power receptacle of claim 7, wherein the outlet element (20) has an outside rim (26), the plug retaining frame (30) has an inside rim (36), and the outside rim (26) and the shell body (10) together clamp the inside rim (36) when the outlet element (20) is fixed on the shell body (10).

11. The power receptacle of claim 7, wherein the plug retaining frame (30) has at least one breach (37), the shell body (10) is provided with at least one light guiding element (17), the top surface (173) of light guiding element (17) is partly located in the breach (37), a pillar body (172) is embedded on at least one second through hole (12) of the shell body (10), so that the top surface (173) of the light guiding element (17) is near to the outlet (21) and the light guiding element (17) guides a light source.

12. The power receptacle of claim 7, wherein the first retaining slot (301) has at least one first protruding portion (35), the second retaining slot (802) has at least one second protruding portion (85), and the first retaining slot (301) and the second retaining slot (802) are biased toward the external side (39) of the plug retaining frame (30) to facilitate insertion of plug strap (50) into the first retaining slot (301) and the second retaining slot (802).

13. The power receptacle of claim 7, wherein the power receptacle is provided with a plurality of the plug retaining frames (30, 30*a*) and a plurality of the outlet elements (20, 20*a*); the plug retaining frames (30, 30*a*) have different colors, and therefore each of the plug retaining frames (30, 30*a*) provides an indication of the respective functions of each of the outlet elements (20, 20*a*) or the respective group of each of the outlet elements (20, 20*a*).

14. A power receptacle having at least one separable plug retaining frame, the power receptacle comprising:

a shell body (10) having at least one first through hole (11);

at least one outlet element (20), the outlet element (20) having at least one outlet (21);

at least one plug retaining frame (30), the plug retaining frame (30) having at least one first bending portion (31), at least one second bending portion (32), at least one first retaining slot (301) and at least one light guiding portion (370);

wherein the outlet element (20) is fixed on the shell body (10), the outlet (21) is exposed to the first through hole (11), a pillar body (372) of the light guiding portion (370) is inserted into a second through hole (12) of the shell body (10), the first bending portion (31) and the second bending portion (32) are held together by the outlet element (20) and the shell body (10), and a plug strap (50) is arranged to be inserted into the first retaining slot (301), and wherein the light guiding portion (370) is near to the outlet (21) and arranged to guide a light source.

15. The power receptacle of claim 14, wherein the outlet element (20) has a plurality of conical blocks (24), the conical blocks (24) block an inner face (14) of the shell body (10) when the outlet element (20) is fixed on the shell body (10), so that the first bending portion (31) and the second bending portion (32) are held together by the outlet element (20) and the shell body (10).

16. The power receptacle of claim 14, wherein the outlet element (20) has an outside rim (26), the plug retaining frame (30) has an inside rim (36), and the outside rim (26) and the shell body (10) together clamp the inside rim (36) when the outlet element (20) is fixed on the shell body (10).

17. The power receptacle of claim 14, wherein the first retaining slot (301) has at least one first protruding portion (35) and the first retaining slot (301) is biased toward the external side (39) of the plug retaining frame (30) to facilitate insertion of plug strap (50) into the first retaining slot (301).

* * * * *